US005104085A

United States Patent [19]

Brice

[11] Patent Number: 5,104,085

[45] Date of Patent: Apr. 14, 1992

[54] EASEL COVER

[76] Inventor: Bernice O. Brice, 842 S. Dalton St., Gastonia, N.C. 28052

[21] Appl. No.: 540,521

[22] Filed: Jun. 19, 1990

[51] Int. Cl.[5] ..... A47B 19/00

[52] U.S. Cl. ..... 248/441.1; 150/154

[58] Field of Search ..... 248/441.1, 455, 460, 248/461, 663, 465; 150/154, 158, 164, 901; 108/90; 160/349.1

[56] References Cited

U.S. PATENT DOCUMENTS

| | | | |
|---|---|---|---|
| 1,326,746 | 12/1919 | Kunath | 150/158 X |
| 1,509,009 | 9/1924 | Weinberg | 150/162 |
| 1,669,616 | 5/1928 | Johnson | 150/162 |
| 3,314,464 | 4/1967 | Veilleux | 150/154 |
| 3,343,578 | 9/1967 | Rubin | 150/155 |
| 3,491,847 | 1/1970 | Abbott | 150/154 X |
| 4,222,138 | 9/1980 | Rowley | 248/461 X |
| 4,667,716 | 5/1987 | Solheim | 150/160 |
| 4,782,873 | 11/1988 | Messner | 150/154 |
| 4,811,767 | 3/1989 | Kessler | 150/901 X |
| 4,869,305 | 9/1989 | Jones | 150/155 |
| 4,948,154 | 8/1990 | Guggenheim | 150/154 X |
| 4,953,697 | 9/1990 | Stanley | 150/159 X |

OTHER PUBLICATIONS

"IBM Technical Disclosure Bulletin" vol. 17 No. 4 published Sep. 1974; "Lockable Drafting Table Cover".

*Primary Examiner*—J. Franklin Foss
*Attorney, Agent, or Firm*—Ralph H. Dougherty

[57] ABSTRACT

An improved article of manufacture for covering a classroom easel and providing a surface for painting thereon. The invented easel cover is a vinyl or fleece-backed vinyl sheet which wraps around the sides of the pad or easel and fastens behind the pad on the easel. A drawstring mechanism is provided to conform the cover to a tray or shelf on the easel.

13 Claims, 2 Drawing Sheets

EASEL COVER

FIELD OF THE INVENTION

The present invention relates to an apparatus for classroom use, and more particularly to a cover for an easel, which is especially useful for drawing and painting thereon, and posting of items of interest thereon.

1. Background of the Invention

In the lower grades of school, particularly preschool, kindergarten, and the first three grades of elementary school, many classrooms are provided with an easel stand which holds a chalk board, acrylic panel, or large pad of paper similar to a flip chart for drawing, painting, finger painting, and writing thereon. Each easel usually has a chalk tray or paint tray at the bottom of the pad. Such easels are used both by the teacher and by the pupils. When used for finger painting, the paints are very messy, difficult to clean up, and if paper is used, the paints often bleed through to lower layers of sheets. Further, large quantities of paper are required if all pupils in a class are to have an opportunity to participate.

2. Description of the Prior Art

As presently used in preschool and kindergarten, newspaper is placed over the easel pad and taped into place for the purpose of fingerpainting, which is a manual dexterity exercise. Cleaning up after this type of use is very inconvenient, as the newspaper becomes damp and soggy, making the handling thereof messy and uncomfortable. In addition, sufficient newspaper must be kept on hand to provide all children the opportunity to participate. The present invention allows serial participation merely by wiping the surface clean after each use.

Applicant is aware of the following U.S. Pat. Nos. concerning cover devices.

| U.S. Pat. No. | Inventor | Title |
|---|---|---|
| 4,372,364 | Katz | DOOR PROTECTOR |
| 2,353,625 | Moore | EASEL |
| 1,752,989 | Hennessy | WRITING BOARD |
| 4,632,241 | Brough et al. | PORTABLE DISPLAY BAG WITH SUPPORT MEANS |
| 4,314,625 | Sarna et al. | ARTIST'S PORTFOLIO |
| 4,776,457 | Ferraroni | COMPARTMENTED DISPLAY CONTAINER WITH PIVOTED COVER SUPPORT |

The Katz patent is for a door protector for furniture movers which hangs over the door by an upper pocket, as shown in FIGS. 1 and 2. The length is adjusted by folding the bottom upwardly and fastening it to itself.

Moore teaches an easel with a collapsible display panel 12 (see FIG. 8), which is the basic utility surface, unlike the present invention.

Hennessy teaches a writing board with a cover of oil cloth, held by pins at the top and snap fasteners at the bottom.

Brough teaches a tripod for supporting a bag having a front closing cover from the top of the tripod by a single pin or hook. This assembly is very unstable and not suitable for use with children.

Sarna teaches a portfolio for an artist which is collapsible and has transparent folders, one on top of the other.

Ferraroni teaches a pivotal cover on a display rack.

None of these references include chalk trays (or paint holding trays or the like) and means for encompassing them. Further, none of the references show a reversible cover, in which the cover is adapted for painting thereon on one side, and for affixing items thereon on the other side.

SUMMARY OF THE INVENTION

The invented easel cover fits over an item sitting on an easel, such as a board, paint canvas, flip chart, chalk board, plastic or acrylic panel or any other such item. However, the cover more frequently will be used over a classroom easel, where the board or panel is attached to the easel by bolts and wing nuts. The cover has a drawstring around the lower horizontal bottom portion to pull around a paint tray or chalk tray and gather the bottom portion. The sides of the cover may be pulled tightly together with two opposed straps, which are preferably mated with Velcro, but any type of fastening can be utilized. The easel cover is preferably reversible, with a cloth or fleece back, which can be utilized for attaching cloth items, such as felt stick-on figures to form designs and pictures.

OBJECTS OF THE INVENTION

The principal object of the invention is to provide an improved cover for an easel for painting thereon.

A further object of this invention is to provide a readily installable and removable easel cover.

Another object of the invention is to provide an easel cover for classroom use which is reversible, that is usable for painting on one face, and for a different activity on the reverse side.

Another object of the invention is to provide an easel cover having an easily cleanable surface.

It is also an object of this invention to provide an easel cover which is readily attachable to a variety of styles of easel, including tripod style, four-legged easel and multi-faced easel.

BRIEF DESCRIPTION OF THE DRAWINGS

The foregoing and other objects will become more readily apparent by referring to the following detailed description and the appended drawings in which.

DETAILED DESCRIPTION

Figure 1:
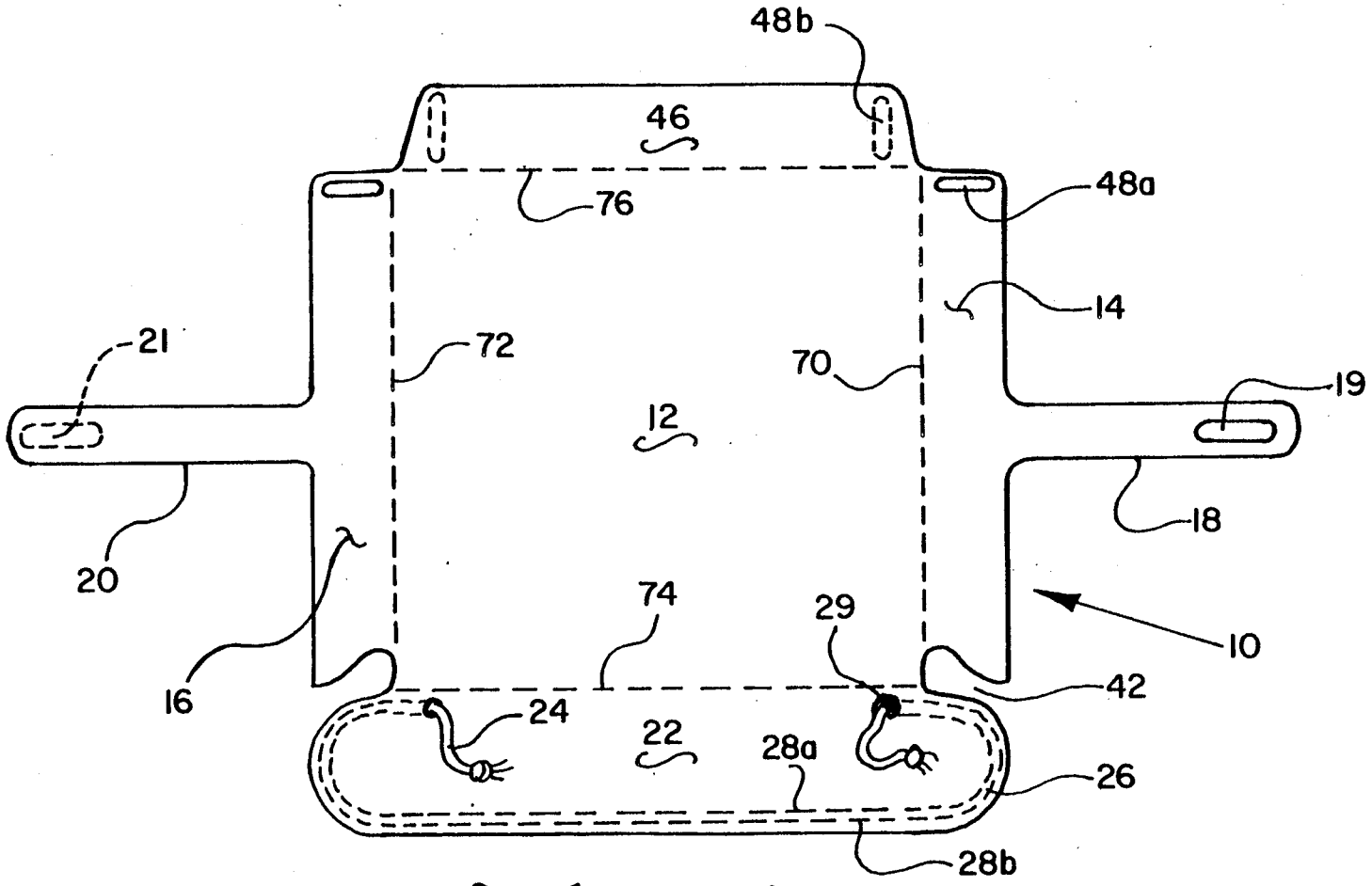
FIG. 1 is a front view of the invented easel cover.

Referring now to the drawings, and particularly to FIG. 1, the invented easel cover 10 includes a generally rectangular central or main panel 12 having right and left fold-around side panels 14 and 16, each side panel carrying connector means such as elongated flaps 18 and 20 for attaching to the opposing flap. Advantageously, each of the elongated flaps carries a VELCRO fastener, one fastener on the front of a flap and the other fastener on the reverse of the other flap. As illustrated, flap 18 carries a VELCRO fastener 19 on its front face and elongated flap 20 carries mating VELCRO fastener on 21 on its reverse. The easel cover also includes a lower forward folding tray cover panel 22 with integral gathering means such as drawstring 24.

There are three standard types of easels in use in the classroom. The most common is the four-legged style easel 30 shown in FIG. 2. A display item such as flip chart 32, a large pad of paper, chalkboard or the like is placed on the easel support tray 34 or it may be fastened directly to the upwardly extending legs 36, 38, of the easel, by bolt and wingnut assemblies 40, as shown. The second style of easel is a triangular or other polygon style easel, shown in FIG. 3 as a three-sided easel with the panels 32 in the vertical position. Another alternative style easel is the three legged tripod style shown in FIG. 4, in which the tripod is provided with an "L" shaped panel support member 60 on each of two legs 62 and 64.

The invented easel cover is preferably a vinyl or fleece-backed vinyl sheet which wraps around the sides of the easel or pad and fastens behind the pad or panel on the easel, preferably by a Velcro fastener. The paint tray or chalk tray 34 for the easel is covered by tray cover panel 22, which is preferably held in place by drawstring 24 passing through a channel or opening 26 defined by at least one seam the outer edge of the lower portion of the cover. Opening 26 can be formed by folding excess material over on the bottom panel 22 and fastening it with a single seam, but preferably is defined by an extra piece of material held in position by dual seams 28*a* and 28*b*. A grommet 29 may be positioned at each end of the drawstring opening to prevent tearing of the material. The drawstring 24 need not be, but may be, long enough to tie, as the gathering effect is itself sufficient to maintain the desired shape of the tray cover panel on the tray 34.

In many easels, there is a gap 41 (see FIG. 3) provided between the bottom of the display item or panel 32 and tray 34. A space 42 between the bottom of side panels 14,16 and the top of tray cover panel 22 allows tucking of the lower portion of panel 12 into gap 41, providing an additional holding mechanism.

Figure 4:
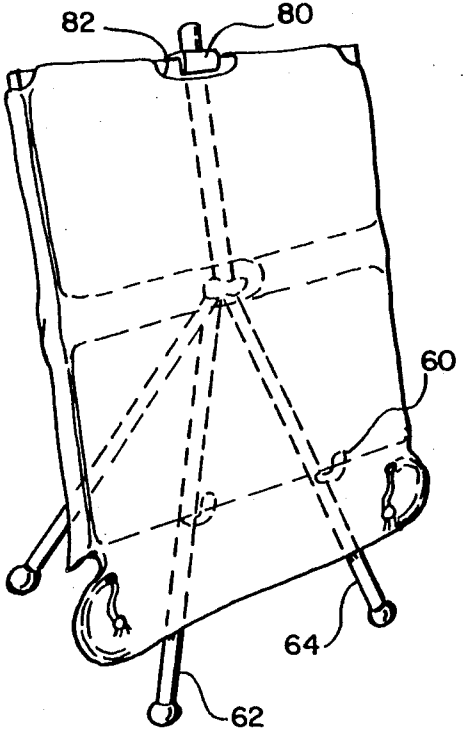
FIG. 4 is a perspective view of an another alternative style easel, a tripod type easel, with the invented easel cover installed thereon.

For easels which have no tray, as in FIG. 4, a fold over top panel 46 is provided, having corner fasteners 48*a*, 48*b* to prevent downward slippage of the easel cover on the display item. In this case, the tray cover panel 22 merely hangs down and performs no special function.

Figure 3:
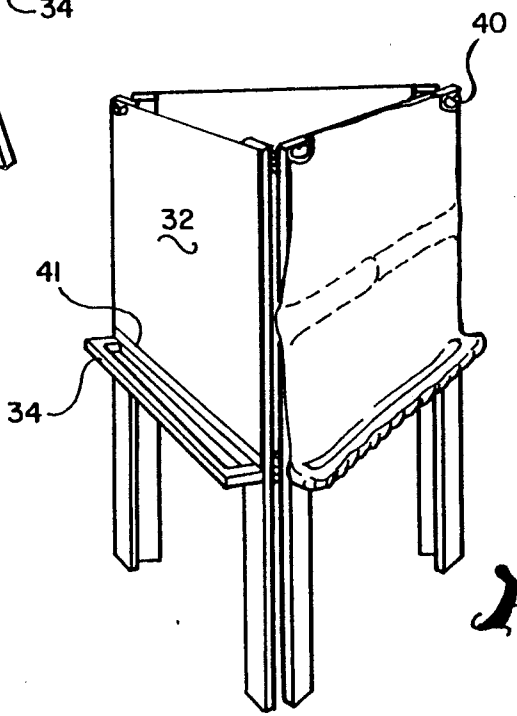
FIG. 3 is a perspective view of an alternative style easel, a triple-faced easel, with the invented easel cover installed on a single face thereof.
Figure 2:
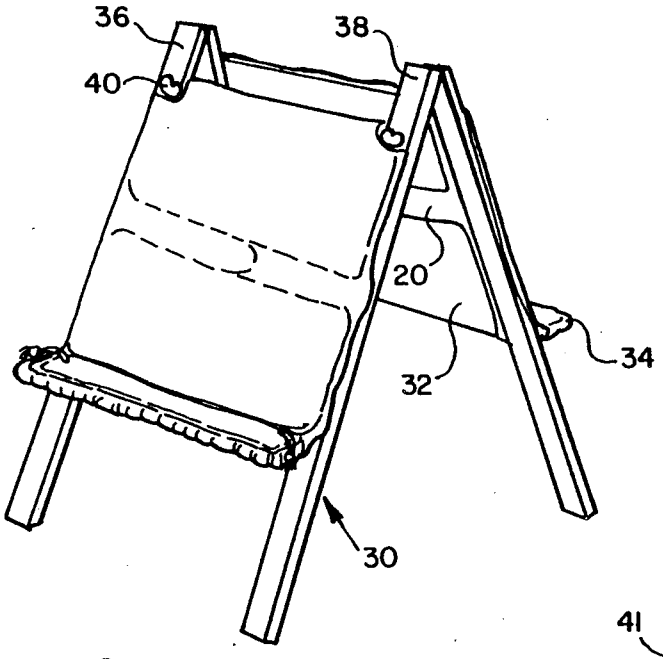
FIG. 2 is a perspective view of a dual sided easel with a pair of the invented easel covers installed on opposite sides thereof.

The cover 10 is installed by folding the side panels about the display item on side panel fold lines 70 and 72 to connect flaps 18 and 20 behind the display item as shown in FIGS. 2 and 4, then folding tray cover panel 22 upwards along fold line 74 and fitting the outer edge containing the drawstring about the tray and pulling both ends of drawstring 24 to fit the tray cover panel about the tray, followed by tucking the bottom of panel 12 between the tray 34 and the display panel 32. Although it is preferable to install the easel cover 10 around only the display item 32 prior to tightening the wingnuts 40, it is also possible to install the easel cover over the legs as shown in FIG. 3.

Suitable materials for the easel cover are vinyl, polypropylene, polyethylene, rubberized cloth, oil cloth, flexible plastic, and the like. The preferable material for school usage is fleece-backed vinyl. The material from which the cover is selected has some innate stiffness, which promotes a tendency for the cover to hold its shape on the easel and to prevent shifting once it is installed.

ALTERNATIVE EMBODIMENTS

The flaps 18 and 20 could be sufficiently long to tie together, could have snaps affixed thereto, could have mating buttons and buttonholes, or other desired fastening means. Multiple snaps or buttons could be provided to allow adjustment for different thicknesses or widths of easels. For an easel with a top suspending hook or clamp, such as bracket 80 in FIG. 4, the easel cover can be provided with a cutout 82 in the center of its top panel 46 along the fold line 76.

SUMMARY OF THE ACHIEVEMENT OF THE OBJECTS OF THE INVENTION

From the foregoing, it is readily apparent that I have invented an improved cover for an easel, which is readily removable, reversible, has an easily cleanable surface, and which is readily attachable to a variety of styles of easel, including tripod style, four-legged easel and multi-faced easel.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A cover for an easel, comprising a generally rectangular main panel having opposing fold around side panels, each side panel carrying connector means for attaching to the opposing side panel; and integral gathering means, and wherein said connector means comprises each side panel having a horizontally extending arm which meets the corresponding arm from the other side panel and carries connecting means thereon.

2. An easel cover according to claim 1 further comprising an edge seam coextensive with the outer peripheral edge of the entire easel cover.

3. An easel cover according to claim 1 made from a material selected from the group consisting of vinyl, polypropylene, polyethylene, oil cloth, rubberized cloth and flexible plastic.

4. An easel cover according to claim 3 made of fleece-back vinyl, whereby the cover is reversible with the vinyl side adapted for receiving paint and the fleece side adapted for receiving self-attaching items.

5. An easel cover according to claim 1 further comprising a foldover top panel, connecting means at each end of said top panel and the top of each side panel for connection of each end of the top panel to a side panel.

6. An easel cover according to claim 5 further comprising wherein said connecting means are VELCRO connectors.

7. An easel cover according to claim 1 wherein said integral gathering means comprises a drawstring opening about the outer edge of said forwardly folding panel, and a drawstring mounted within said drawstring opening.

8. An easel cover according to claim 1 wherein the bottom of each side panel is spaced from the top of said tray cover panel.

9. An easel cover according to claim 1 wherein the reverse face of the cover is cloth.

10. An easel cover according to claim 9 wherein the reverse cloth face of the cover is selected from the group consisting of fleece, felt, cotton, and wool.

11. In combination with an easel having at least three legs, means for supporting a rectangular display item thereon, and a rectangular display item supported on said easel, the improvement comprising:

an easel cover mounted on said display item, said cover comprising a generally rectangular main panel having opposing fold around side panels, each side panel carrying connector means attached behind said display item to connector means on the opposing side panel; and a lower forward folding tray cover panel having integral drawstring gathering means.

12. The combination according to claim 11 wherein the easel cover is of a material selected from the group consisting of vinyl, polypropylene, polyethylene, oil cloth, rubberized cloth and flexible plastic.

13. The combination according to claim 12 wherein the easel cover is fleece-backed vinyl, whereby it is reversible.

* * * * *